US007040565B2

(12) United States Patent
Fabio

(10) Patent No.: US 7,040,565 B2
(45) Date of Patent: May 9, 2006

(54) APPARATUS FOR CONTROLLING THE SPEED OF LOGS ON OUTPUT FROM A REWINDING MACHINE

(76) Inventor: Perini Fabio, Via S. Francesco 1 - 55049, Viareggio (Lucca) (IT)

( * ) Notice: Subject to any disclaimer, the term of this patent is extended or adjusted under 35 U.S.C. 154(b) by 0 days.

(21) Appl. No.: 10/954,671

(22) Filed: Sep. 30, 2004

(65) Prior Publication Data

US 2005/0092863 A1 May 5, 2005

(30) Foreign Application Priority Data

Oct. 2, 2003 (IT) ..... FI2003A0253

(51) Int. Cl.
*B65H 19/22* (2006.01)
*B65H 75/30* (2006.01)
*B65H 49/02* (2006.01)

(52) U.S. Cl. ..... 242/533; 242/396.6; 242/422.5; 242/542

(58) Field of Classification Search ..... 242/615.4, 242/473.4, 473.5, 542.3, 542.4, 533, 533.3, 242/533.2, 610, 610.6, 615.2, 542, 542.2, 242/520, 396.6, 396.7, 396.8, 422.5
See application file for complete search history.

(56) References Cited

U.S. PATENT DOCUMENTS

| | | | | |
|---|---|---|---|---|
| 4,327,877 | A * | 5/1982 | Perini | 242/521 |
| 5,240,198 | A * | 8/1993 | Dorfel | 242/542.4 |
| 5,772,149 | A * | 6/1998 | Butterworth | 242/533.2 |
| 6,056,230 | A * | 5/2000 | Peters et al. | 242/541.5 |
| 6,105,897 | A * | 8/2000 | Cramer et al. | 242/541 |
| 6,269,859 | B1 * | 8/2001 | Semba | 156/457 |
| 6,565,033 | B1 | 5/2003 | Biagiotti | |
| 2003/0001042 | A1 | 1/2003 | Betti et al. | |
| 2004/0178295 | A1 * | 9/2004 | Betti et al. | 242/533 |

FOREIGN PATENT DOCUMENTS

| | | |
|---|---|---|
| WO | WO 01/64563 | 9/2001 |

* cited by examiner

*Primary Examiner*—Kathy Matecki
*Assistant Examiner*—William E. Dondero
(74) *Attorney, Agent, or Firm*—McGlew & Tuttle, P.C.

(57) ABSTRACT

An apparatus for controlling the speed of logs (3) on discharge or output from a rewinding machine. The apparatus include; structure for slowing down the logs (3) rolling along a log discharge or output plane (5). This structure includes a roller (6) located above the log output put plane (5) and having axis (a) parallel to the axis of the logs (3). The same roller is driven into rotation about its axis with a preset angular speed so as to intercept each of the logs (3) and slow down the motion thereof along the plane (5). The surface of the roller (6) is pliable and elastic.

10 Claims, 2 Drawing Sheets

APPARATUS FOR CONTROLLING THE SPEED OF LOGS ON OUTPUT FROM A REWINDING MACHINE

The present invention refers to an apparatus for controlling the discharge of logs from a rewinding machine.

BACKGROUND OF THE INVENTION

Rewinding machines are known to be used for winding a predetermined amount of paper or other web material around a tubular spool, mostly made of cardboard and commonly called "core", so as to produce reels, called "logs" in jargon, which have a preset diameter.

The winding-up of material onto the core is carried out at a station provided with a pair of winding rollers by means of which the logs are held and caused to rotate around the longitudinal axis of the core until the required diameter is reached. Rewinding machines of this type are described, for example, in U.S. 2003/0001042 A1, U.S. Pat. No. 6,565,033 and WO 01/64563.

Upon completion of the winding, it is necessary to discharge the log from the rewinding machine to feed the same log to further treatments. To this end, the log is released from the hold of said rollers and it results therefore free of rolling down along the exit plane out of the machine. However, since the release of the log takes place without a preventive slowing down of the winding rollers, it rolls along said exit plane with a speed which is higher than that required for the operations performed in the stations located downstream. Accordingly, it is necessary to slow down the logs upon their exit from the rewinding machine.

SUMMARY OF INVENTION

The main object of the present invention is to propose an apparatus for effectively controlling the discharge of logs with no damages resulting on the latter.

This result has been achieved, according to the invention, by adopting the idea of making an apparatus having the characteristics disclosed in the claim 1. Further characteristics being set forth in the dependent claims.

The advantages of the present invention lie essentially in that it is possible to control very effectively the speed of logs on discharge or output from the rewinding machine; that it is possible to maintain the integrity of the logs thus controlled; that an apparatus according to the invention is simple to construct, cost-effective and reliable even after a prolonged service life.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE INVENTION

Figure 1:
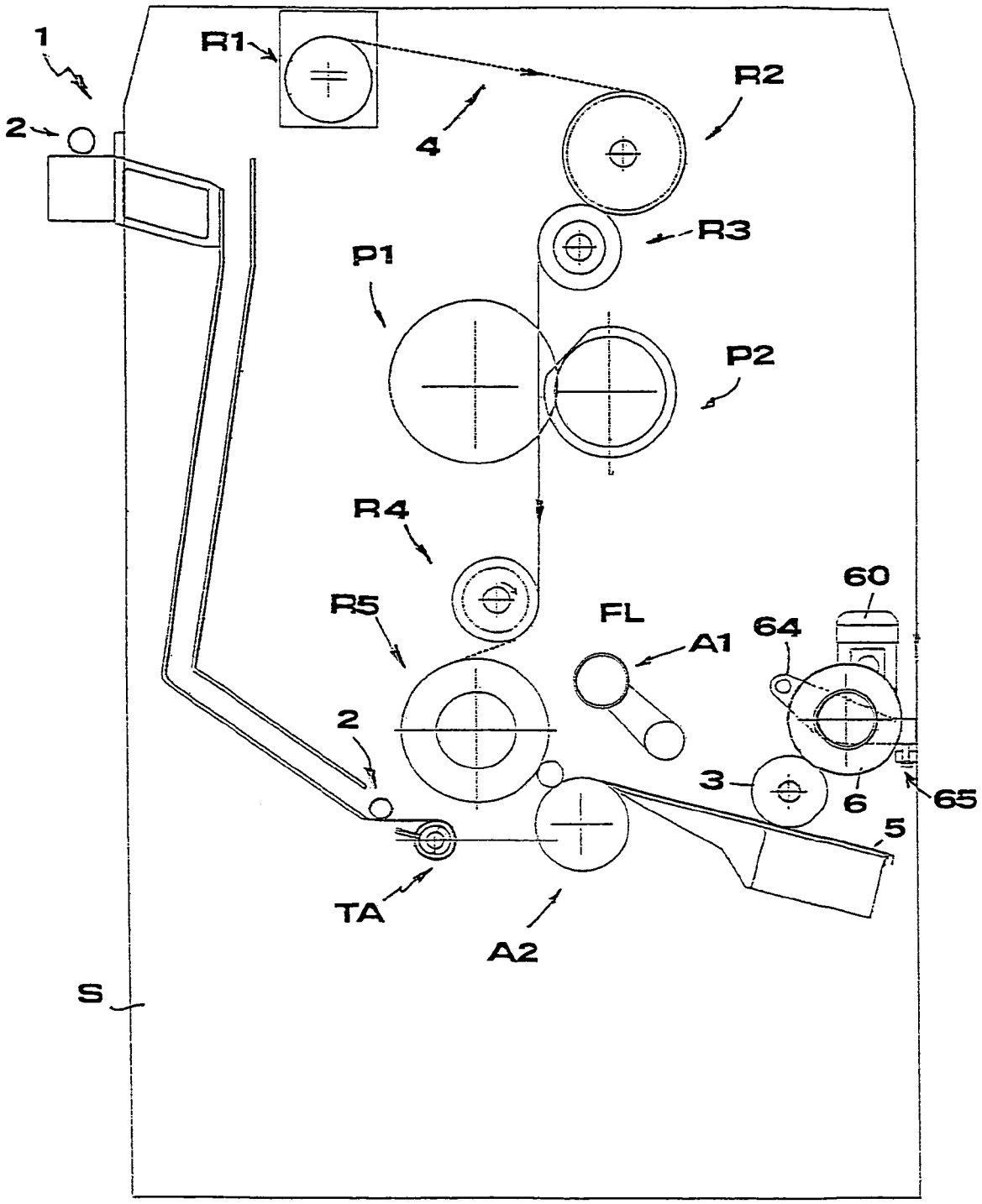
FIG. 1 is a schematic view of a rewinding machine provided with a control apparatus according to the invention.

In FIG. 1, the following components of a rewinding machine are schematically shown only for the purpose of pointing out the positioning of the apparatus of the present invention:

- a unit (1) for feeding the cores (2) around which the logs (3) are formed;
- a plurality of cylinders or rollers (R1, R2, R3, R4, R5) for supplying a web of paper (4);
- two perforating rollers (P1, P2) able to produce, upstream of logs-forming station (FL), a series of transverse, equidistant perforations on the paper web (4);
- two winding rollers (A1, A2) disposed and acting in correspondence of said logs-forming station (FL);
- a device (TA) for guiding the cores (2) along a length between the output section of said unit (1) and the lower winding roller (A2) of station (FL);
- a chute (5) on which the logs (3) can roll after having been released from the hold of the winding rollers (A1, A2): the said chute (5) being downstream of said station (FL);
- a stationary structure (S) which supports the said components.

The operation of a machine so constructed is known to those skilled in the art and, therefore, will not be described in greater details.

An apparatus for controlling the speed of logs (3) on discharge or output from a rewinding machine, according to the invention, comprises a roller (6) located above said chute (5) downstream of said rollers (A1, A2), with axis (a) parallel to the axis of the logs (3) exiting from the machine.

The said roller (6) is associated with a corresponding electric motor (60) which drive it into rotation with a preset angular speed about its longitudinal axis.

The surface of said roller (6) is pliable and elastic, to allow a temporary deformation thereof as best described below.

Figure 6:
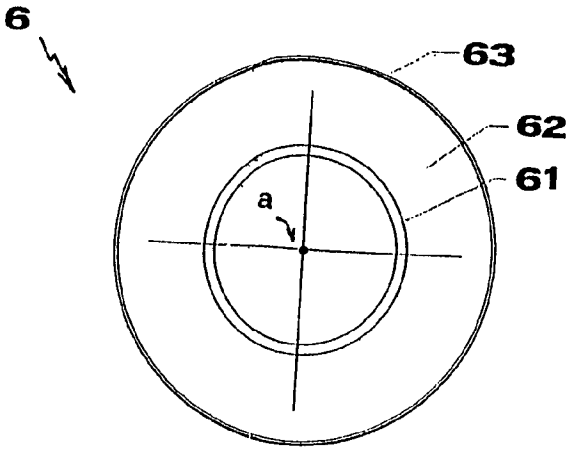
FIG. 6 is a schematic cross-section view of the roller used within the apparatus shown in FIGS. 1–5.
Figure 2:
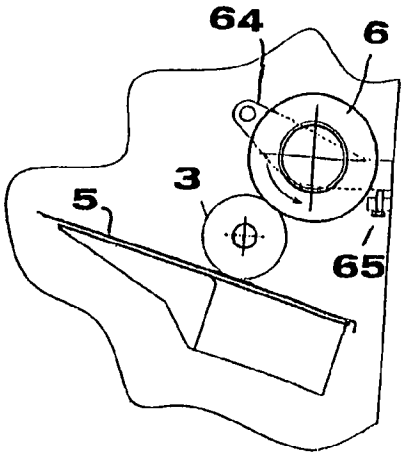
FIGS. 2–5 are schematic views of an apparatus according to the invention showing four different operating steps.

For example, and reference being made to FIG. 6, the roller (6) is made up of a central tubular core (61) having fitted thereon a foam-rubber tube (62) coated with an anti-adhesive material (63) such as TEFLON®, for example.

The roller (6) is mounted on a support (64) whose distance from the plane (5) is adjustable, for example, by a register screw (65), in relation to the diameter of the logs (3) to be treated.

The operation of the apparatus above described is as follows.

Figure 3:
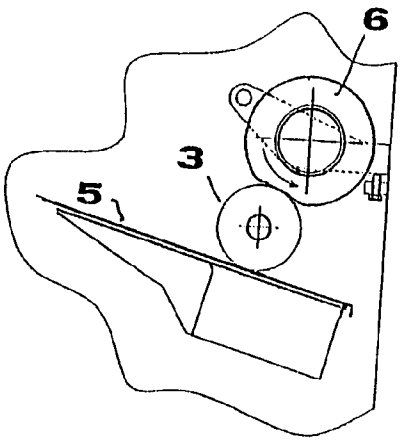
Figure 4:
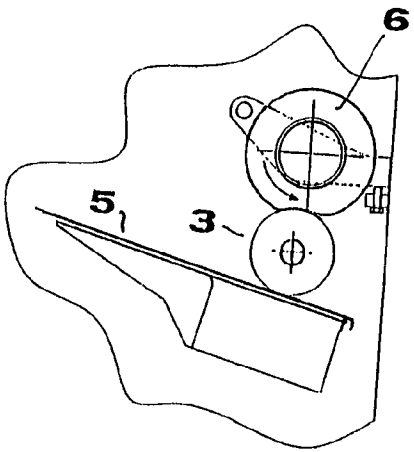
Figure 5:
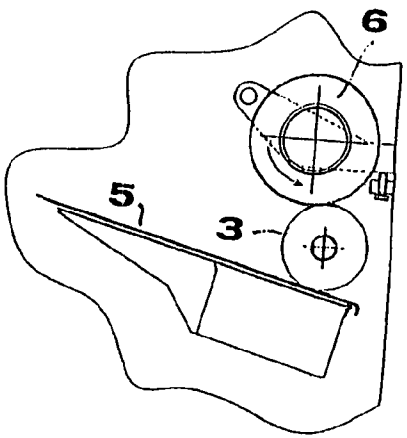

When released from the rollers (A1, A2) of station (FL) a log (3) begins to roll along the plane (5) with a speed which depends on the operating speed of said rollers. The same log is intercepted on the plane (5) by the roller (6) lying at such a distance therefrom, so as to prevent the free transit of the log (3), and rotating with an angular speed which is less than that of the log (3) rolling on the plane (5). The log (3) is thus subjected to a slowing down, that is, its speed is lowered to the desired value. The contact between the log (3) and the roller (6) is accompanied by a temporary deformation of the latter, as shown in FIGS. 3 and 4. Such deformation concerns solely the area of the roller (6) in contact with the log (3), without any excessive deformation of the latter, as the material which the roller (6) is made of is more pliable. Throughout the time of contact, the log (3) keeps rolling on the plane (5), until it comes out of the groove, delimited above by the roller (6) and below by the plane (5), with a speed which is less than that the same log had prior to be intercepted by the roller (6). The speed of the log (3) exiting from this apparatus corresponds to that required to allow further treatments thereof downstream.

The surface, anti-adhesive coating (63) of the roller (6) results particularly advantageous when the logs (3) have their upper edge glued, and the glue is not dried yet.

The resilience of the material (62) allows a spontaneous restoration of the initial cylindrical conformation of the roller (6) once the log (3) has passed the said groove.

Moreover, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

What is claimed is:

1. An apparatus for controlling the speed of logs on discharge or output from a rewinding machine discharging logs after formation along an output plane moving along the output plane at an output speed, the apparatus comprising:

a roller cooperating with said output plane to define a gap, said roller having a roller axis parallel to the axis of the logs along the output plane, said gap being dimensioned such that said roller contacts the logs as the logs move along the output plane and said roller being pliable and elastic on the surface and being driven into rotation about said roller axis with a preset angular speed so as to slow down the motion of the logs as the logs move past the roller along said output.

2. An apparatus according to claim 1, further comprising an electric motor driving said roller.

3. An apparatus according to claim 1, wherein said roller comprises a central tubular core having fitted thereon a tube of foam-rubber material coated with an anti-adhesive material.

4. The apparatus of claim 1, further comprising an adjustable mount supporting said roller wherein a distance of said roller from said plane is adjustable.

5. An apparatus for forming and feeding a log comprising a core with a web material wound thereon, the apparatus comprising:

an output plane;

a rewinding machine forming the logs and releasing the logs so as to be rolling along said output plane at an output speed having an rolling log angular speed of rotation;

a decelerator roller positioned spaced from said plane and being driven in rotation about an axis parallel to the axis of the logs along the output plane at an angular speed of rotation which is less than said rolling log angular speed of rotation, said deceleration roller being disposed to contact the logs rolling along said plane for producing a deceleration of the rolling logs, said deceleration roller being pliable and elastic on the surface with the contact between said rolling logs and said decelerator roller being accompanied by a temporary deformation of said decelerator roller for maintaining said logs rolling throughout a time of contact between the log and the decelerator roller.

6. An apparatus according to claim 5, further comprising an electric motor driving said decelerator roller.

7. An apparatus according to claim 5, wherein said roller comprises a central tubular core having fitted thereon a tube of foam-rubber material coated with an anti-adhesive material.

8. The apparatus of claim 5, further comprising an adjustable mount supporting said roller wherein a distance of said roller from said plane is adjustable.

9. A method for producing logs, the method comprising the step of:

providing an output plane;

forming a log with a core with a web material wound thereon using a rewinding machine and releasing the logs so as to be rolling along said output plane at an output speed;

providing a decelerator roller positioned along said output plane;

decelerating the logs rolling along said output plane at said output speed, said deceleration roller being disposed to contact the logs rolling along said plane while being rotationally riven at a preset angular speed, said deceleration roller being pliable and elastic on the surface for maintaining said logs rolling throughout a time of contact between the log and the decelerator roller.

10. A method according to claim 9, wherein the contact between said rolling log and said decelerator roller is accompanied by a temporary deformation of the latter.

* * * * *